US006926084B2

(12) United States Patent
Erstad

(10) Patent No.: US 6,926,084 B2
(45) Date of Patent: Aug. 9, 2005

(54) APPARATUS FOR TRANSFERRING HYDROCARBONS FROM A SUBSEA SOURCE TO A VESSEL

(75) Inventor: Jostein Erstad, Ask (NO)

(73) Assignee: Framo Engineering AS, Bergen (NO)

( * ) Notice: Subject to any disclaimer, the term of this patent is extended or adjusted under 35 U.S.C. 154(b) by 0 days.

(21) Appl. No.: 10/451,680

(22) PCT Filed: Feb. 19, 2002

(86) PCT No.: PCT/NO02/00068

§ 371 (c)(1),
(2), (4) Date: Aug. 14, 2003

(87) PCT Pub. No.: WO02/072413

PCT Pub. Date: Sep. 19, 2002

(65) Prior Publication Data

US 2004/0042856 A1 Mar. 4, 2004

(30) Foreign Application Priority Data

Feb. 19, 2001 (NO) ..... 2001 0850
Jan. 8, 2002 (NO) ..... 2002 0091

(51) Int. Cl.[7] ..... F16L 1/00; E21B 43/00
(52) U.S. Cl. ..... 166/345; 137/597
(58) Field of Search ..... 166/76.1, 97.1, 166/344–345; 137/15.09, 597, 580

(56) References Cited

U.S. PATENT DOCUMENTS 1,971,381 A * 8/1934 Penick et al. ..... 166/97.1
4,448,568 A * 5/1984 Gentry et al. ..... 405/168.3
5,697,732 A * 12/1997 Sigmundstad ..... 405/169
5,895,077 A 4/1999 Sigmundstad
6,021,848 A * 2/2000 Breivik et al. ..... 166/344
6,050,747 A 4/2000 Midttveit

* cited by examiner

*Primary Examiner*—Sunil Singh
(74) *Attorney, Agent, or Firm*—Sughrue Mion, PLLC

(57) ABSTRACT

An apparatus for transferring hydrocarbons from a subsea source to a vessel, wherein the risers are suspended from a rotating body and communicate with a swivel unit including a number of swivel rings having outlets connected to a pipe system on the vessel. The apparatus includes a block arranged between the risers and the swivel unit and provided with interior ducts for connection of the risers with respective swivel rings, and a device for selective closing of the ducts are arranged between the risers and the swivel unit. The device is integrated in the block. In an advantageous embodiment, the block is also provided with a device for selective interconnection of two or more of the ducts in the block.

11 Claims, 9 Drawing Sheets

PRIOR ART

APPARATUS FOR TRANSFERRING HYDROCARBONS FROM A SUBSEA SOURCE TO A VESSEL

FIELD OF THE INVENTION

The invention relates to an apparatus for transferring hydrocarbons from a subsea source to a vessel, wherein a number of risers are suspended from a rotating body and communicate with a swivel unit comprising a number of swivel rings having outlets which are coupled to a pipe system on the vessel, the apparatus comprising a block arranged between the risers and the swivel unit and provided with interior ducts for connection of the risers with respective swivel rings, means for selective closing of the ducts being arranged between the risers and the swivel unit.

RELATED ART

In offshore production of hydrocarbons (oil or gas) there are today often used floating production vessels. The vessel is kept in position above an oil or gas field by means of a suitable anchoring, and the oil and/or gas (the production) is conducted into the vessel by means of risers extending from the seabed up to a rotating body (turret) on the vessel.

The production is often transferred to the vessel in several independent risers. On the turret the production is conducted through a swivel and into the processing plant on the vessel. On suitable occasions, for example once per week, produced oil is transferred to a shuttle tanker.

It is very important that the production can take place continuously in order to avoid great economic losses, and it is therefore important to be able to protect oneself against faults which may cause shutdown of the production in one or more of the risers.

It is possible that faults may occur in the sealing system on one of the swivel rings after the outlet from the associated riser. In order to stop leakage of oil or gas, the fluid flow through this riser has to be stopped in that valves on the connections into and out of the swivel are closed. This may imply that the production going from the riser which is connected to said swivel ring, is stopped, with a great economic loss as a result.

BRIEF SUMMARY OF THE DRAWINGS

On this background it is an object of the invention to provide an apparatus having a compact construction which eliminates pipes and reduces the number of flange connections, so that the number of possible leakage points is reduced, at the same time as the construction enables disconnection between the vessel and the riser system in a relatively short time.

Another object of the invention is to provide an apparatus enabling reconnection of the production from one or more risers from one swivel ring to another in a practical, simple, safe and quick manner, so that loss of production can be avoided or limited.

For the achievement of the above-mentioned objects there is provided an apparatus of the introductorily stated type which, according to the invention, is characterised in that the means for selective closing are integrated in the block.

The apparatus according to the invention is particularly advantageous and cost-effective for smaller fields where there is a need for a limited number of risers. By means of the apparatus there is obtained a compact construction involving a reduced number of flange connections and therewith a reduced number of leakage points, something which will be an advantage with respect to security.

In an advantageous embodiment of the apparatus, wherein said rotating body consists of a buoy which can be connected to the vessel, the block consists of two block units of which an upper block unit is permanently secured to the swivel unit and a lower block unit is permanently secured to the buoy, the two block units being arranged for releasable interconnection with each other.

By means of this embodiment there is obtained a common connection point which may either be bolted or comprise a remotely operated connection means. This will imply a reduced number of working operations and a reduced time consumption in case of a possible disconnection.

There may be arranged common fluid courses through the swivel unit and the upper block unit, wherein these courses are split up in the lower block unit. This implies that one gets a cost-optimal solution wherein the number of seals and valves are reduced to a minimum. This may be an attractive solution for a gas lift swivel.

A further advantageous embodiment of the apparatus according to the invention is characterised in that the block is also provided with means for selective interconnection of two or more of the ducts in the block.

By means of this embodiment there is provided an apparatus which in advance is prepared for the relevant reconnections, so that these can be carried out in a safe and quick manner.

BRIEF DESCRIPTION OF THE DRAWINGS

Figure 1:
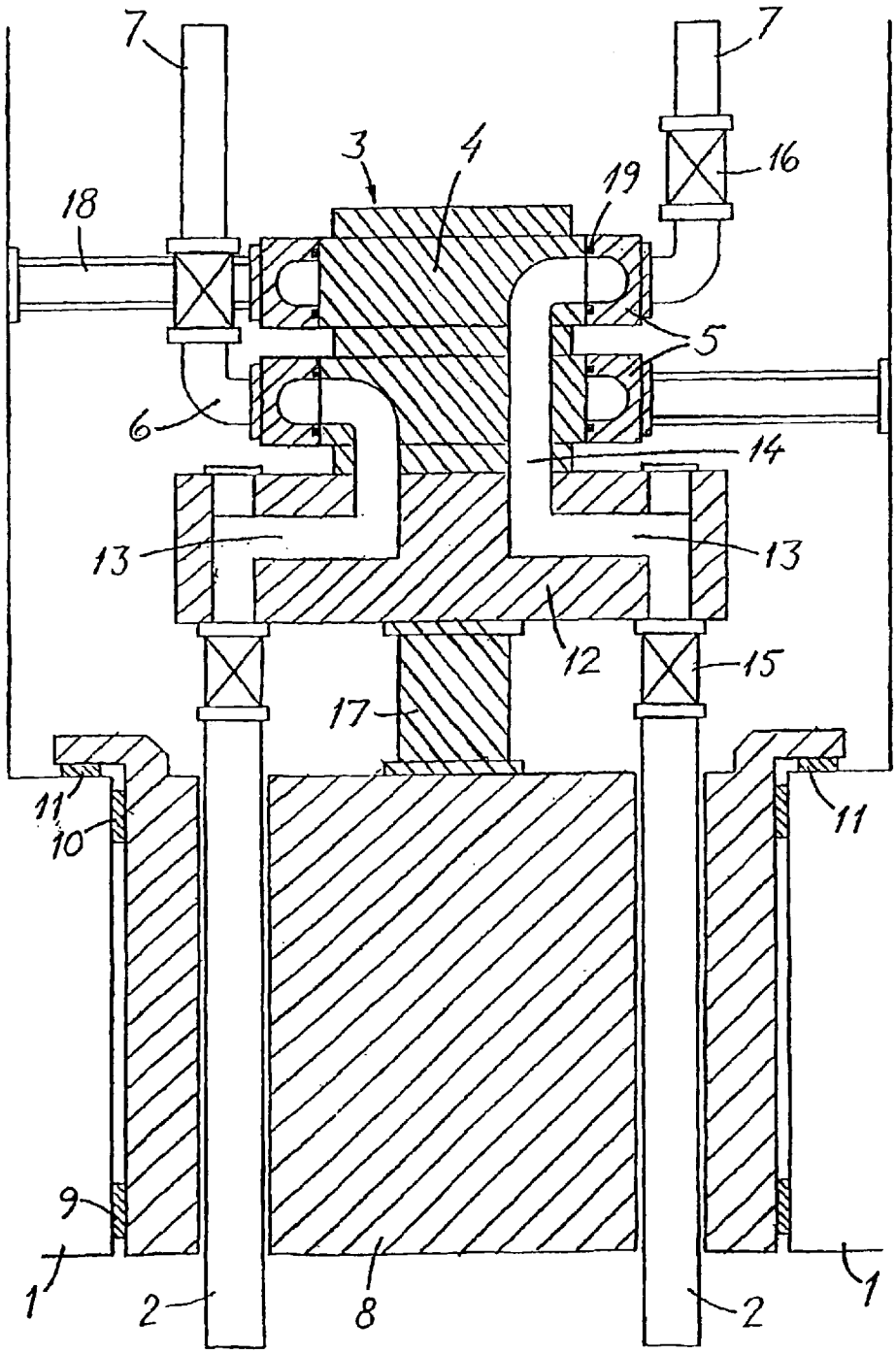
FIG. 1 PRIOR ART
Figure 2:
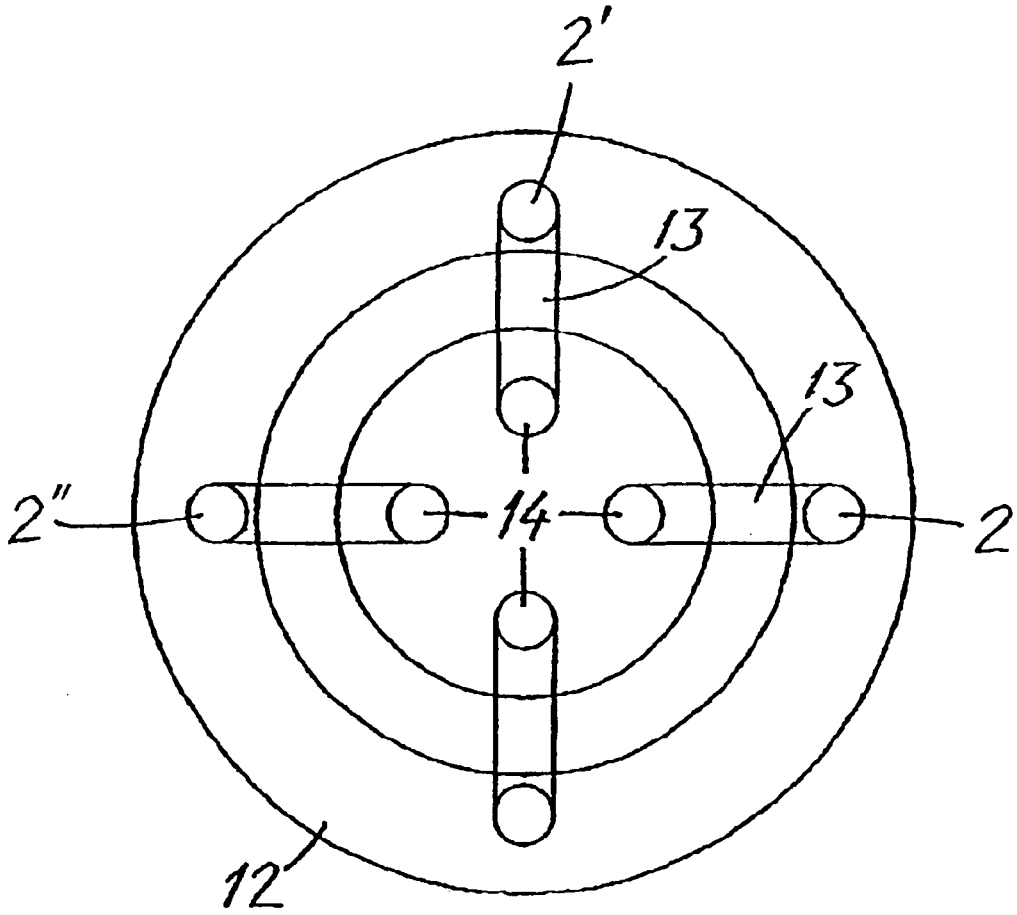
Figure 3:
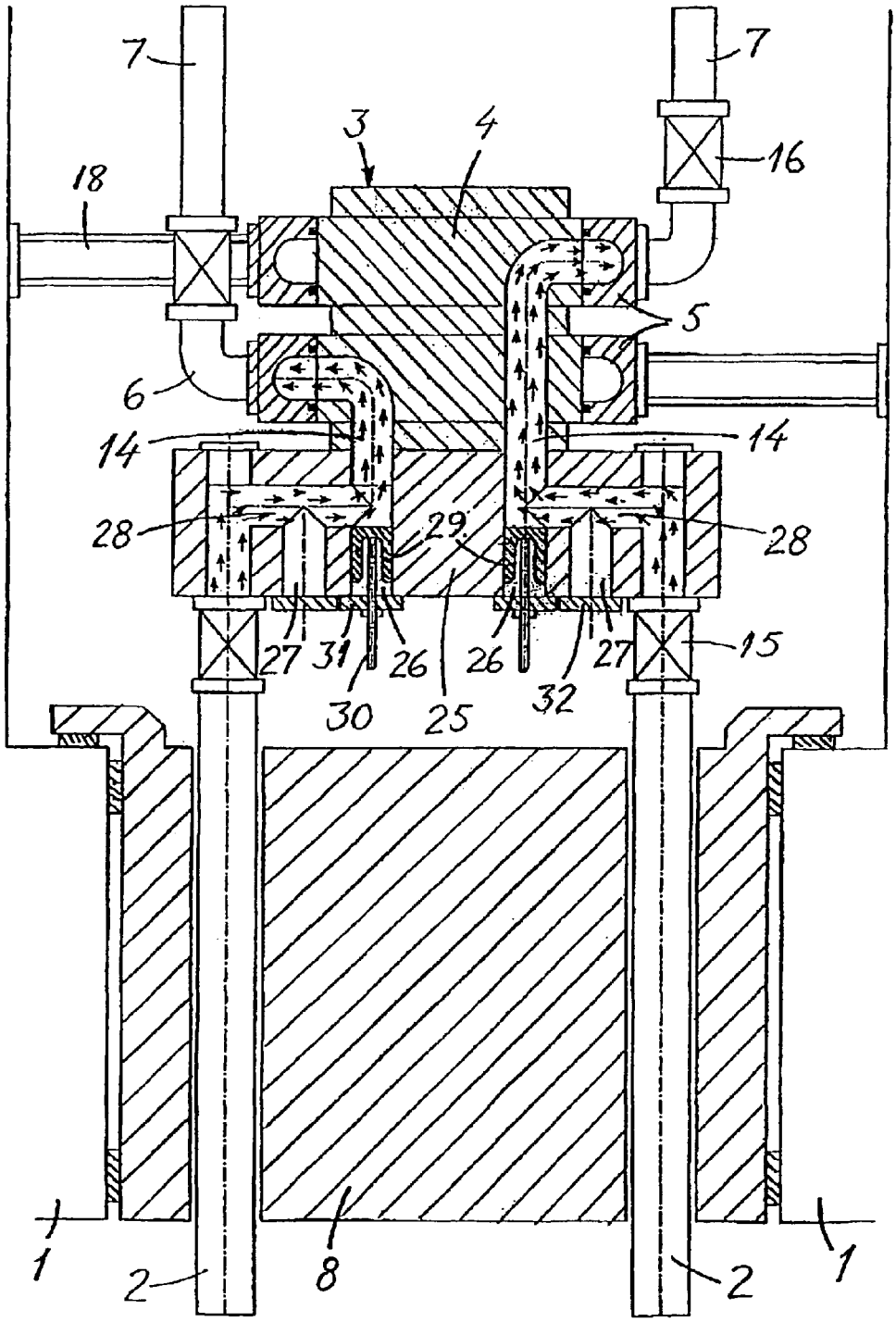
Figure 4:
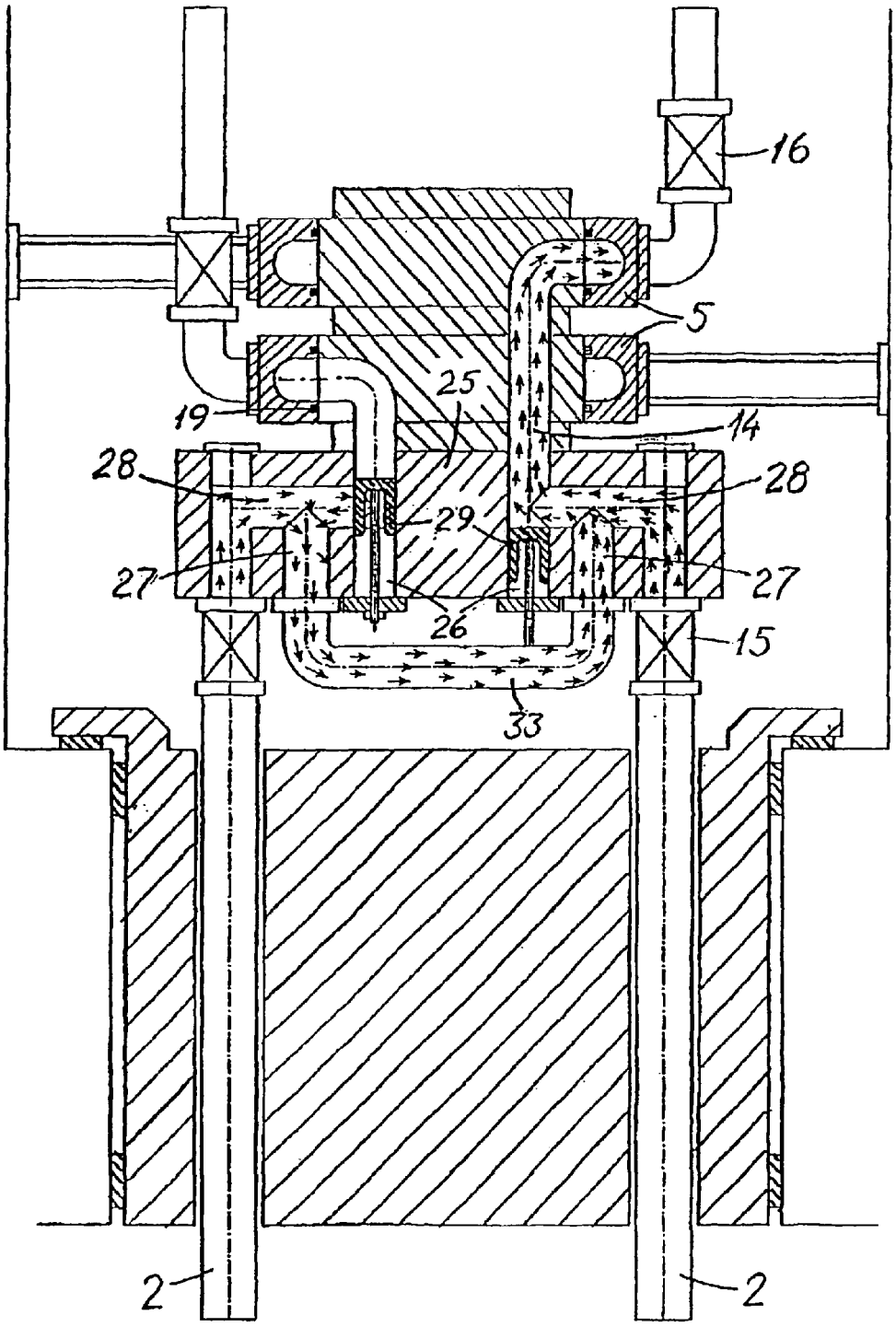
Figure 5:
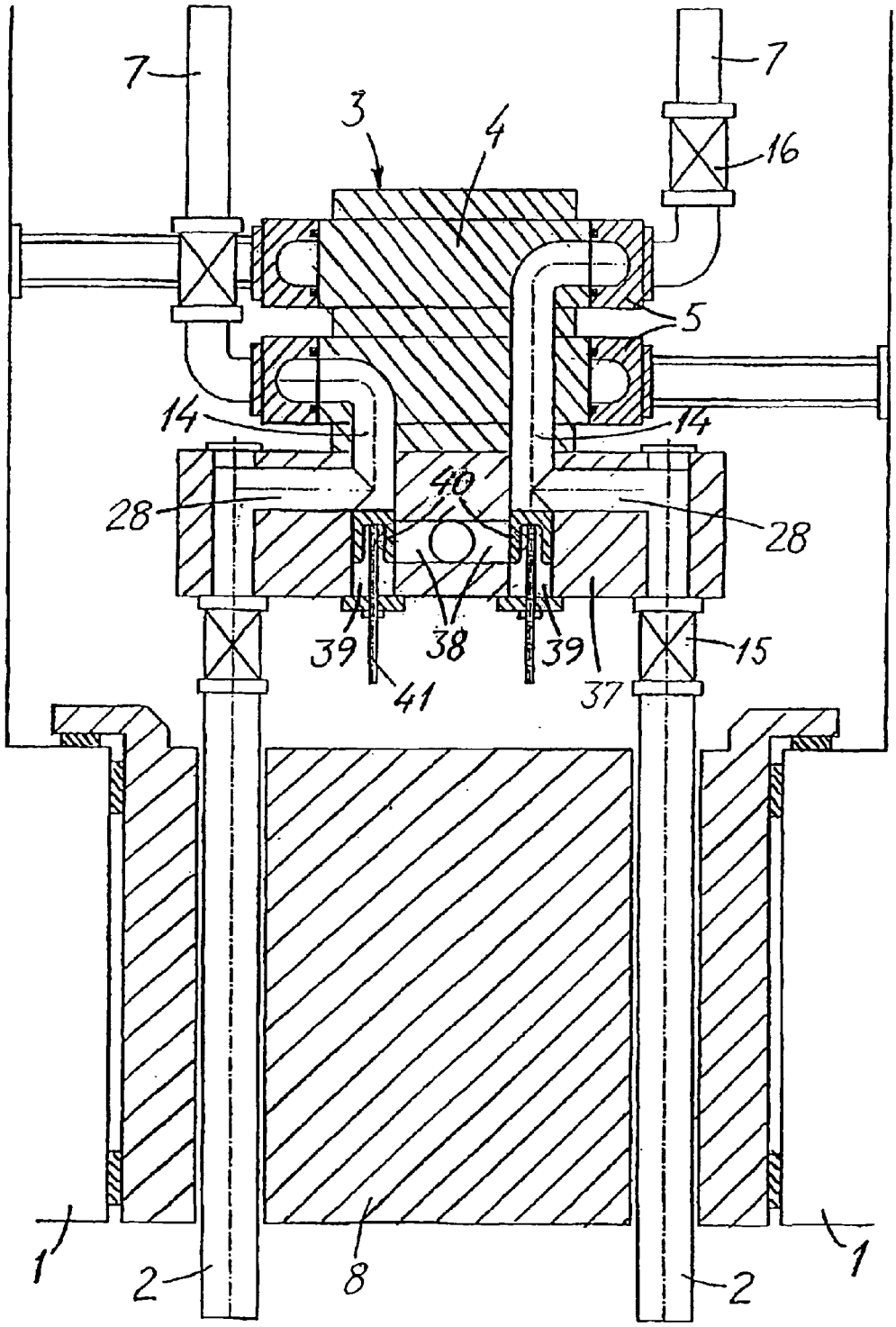
Figure 6A:
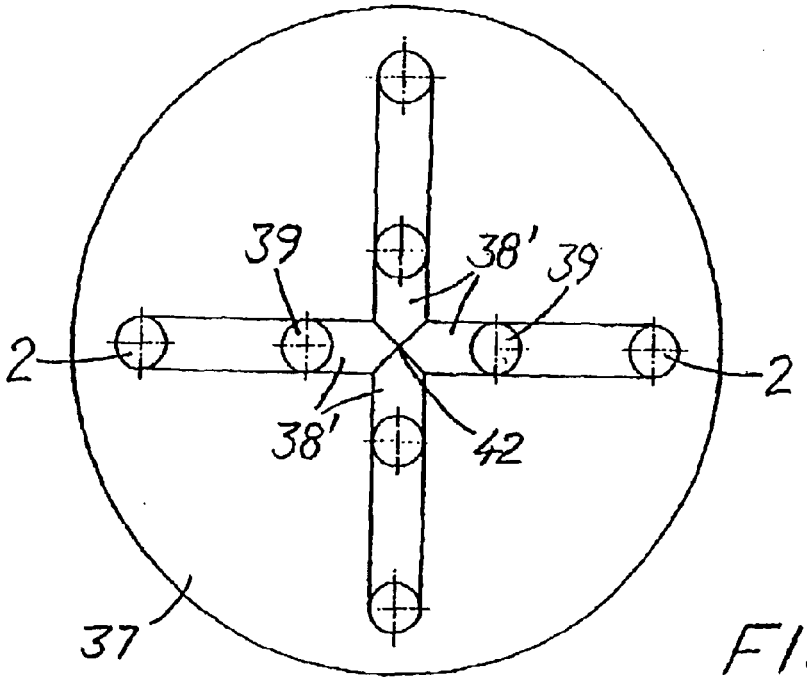
Figure 6B:
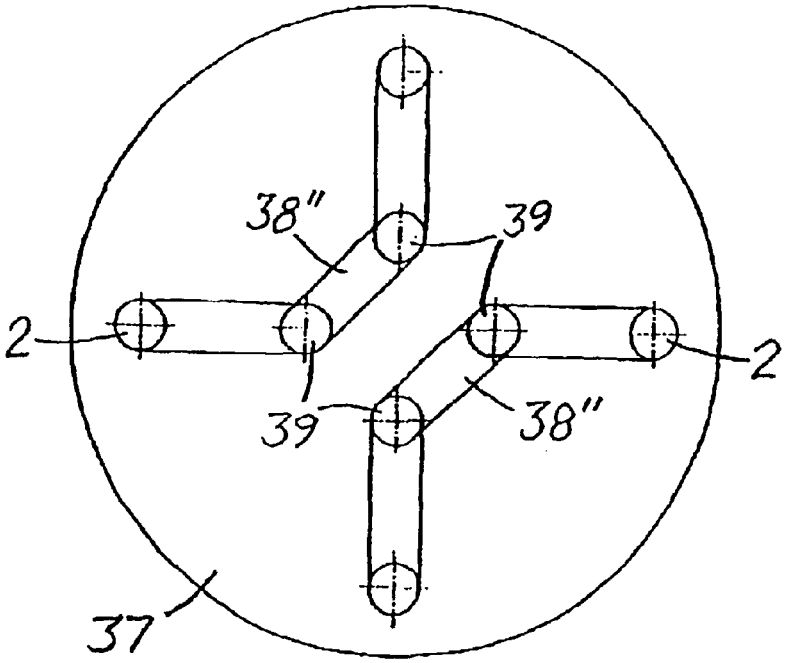
Figure 7:
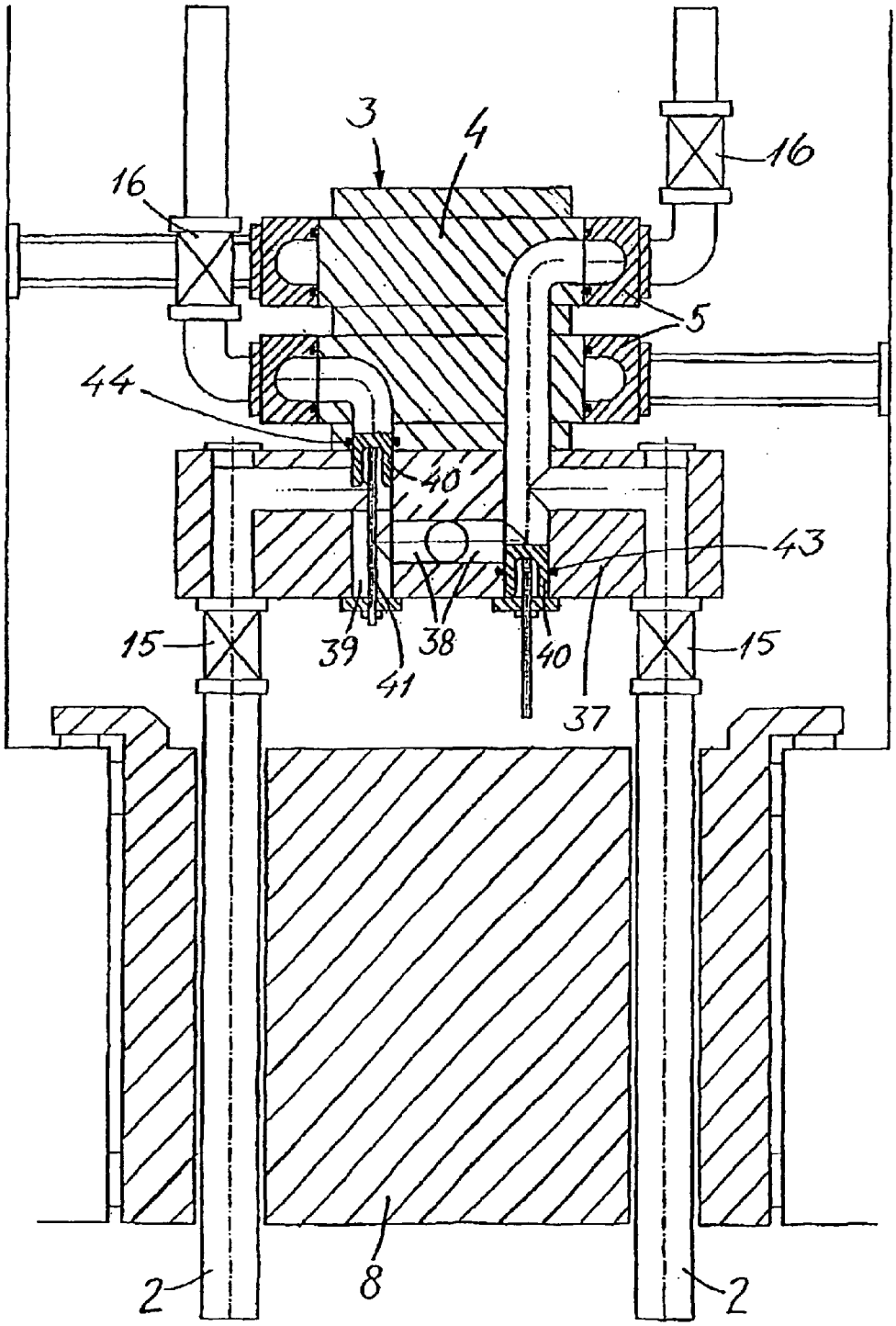
Figure 8:
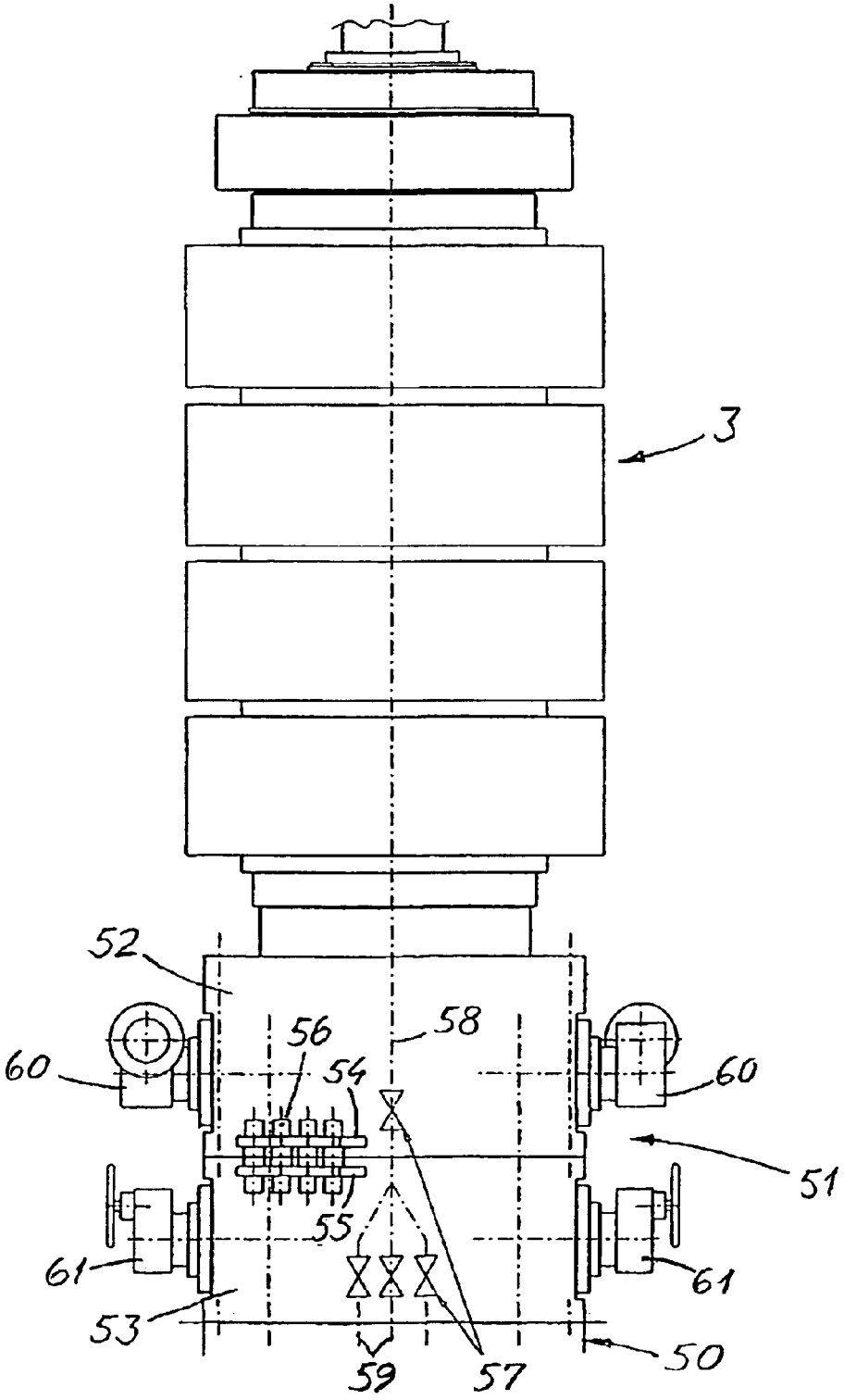
Figure 9:
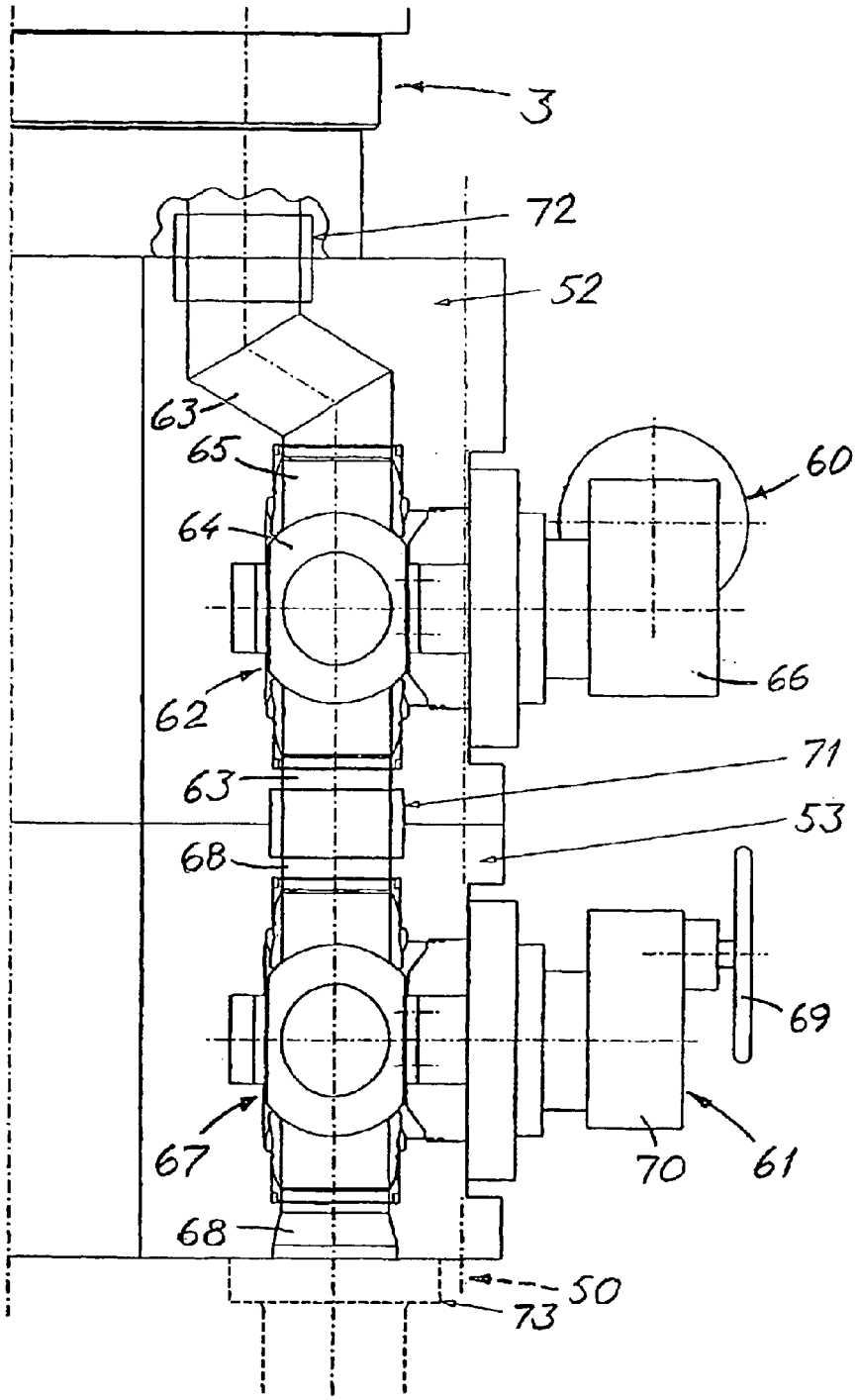

The invention will be further described below in connection with exemplary embodiments with reference to the drawings, wherein FIG. 1 shows a vertical sectional view of a rotating body and swivel assembly according to the prior art;

FIG. 2 shows an example of ducts in the block between the risers and the swivel unit in FIG. 1;

FIG. 3 shows a first embodiment of an apparatus according to the invention, in a sectional view corresponding to that of FIG. 1, wherein the block is provided with means according to the invention in the form of additional bores and closing plugs;

FIG. 4 shows the arrangement in FIG. 3, wherein a branch pipe is connected between two of the bores;

FIG. 5 shows a sectional view corresponding to that of FIGS. 3 and 4, but of an alternative embodiment wherein the block is provided with interior interconnection ducts instead of outer branch pipes;

FIGS. 6A and 6B show examples of possible arrangements of interconnection ducts in the block;

FIG. 7 shows the embodiment according to FIG. 5, wherein the closing plugs are moved to respective operational positions, so that the liquid flow from both of the illustrated risers is guided to the upper swivel ring in the swivel unit;

FIG. 8 shows a side view of an apparatus according to the invention in an embodiment comprising a pair of mutually interconnected block units which are provided with integrated means for selective closing; and FIG. 9 shows an enlarged section of the block units in FIG. 8 with integrated closing means.

DETAILED DESCRIPTION OF EXEMPLARY EMBODIMENTS OF THE INVENTION

In the various Figures, corresponding parts are designated by the same reference numerals.

FIG. 1 shows a conventional installation for the transfer of hydrocarbons (oil and/or gas) from a subsea source (not shown) to a non-illustrated processing plant on a production vessel suggested at 1 in the Figure. The vessel may be a so-called FPSO vessel, i.e. a vessel for production, storage and off-loading of oil or gas. The oil or gas is transferred via a number of risers 2 and a swivel unit 3 comprising a swivel core 4 and a number of swivel rings 5 having outlets 6 which are coupled to respective pipes or conduits 7. The pipes 7 form part of a pipe system leading to the processing plant on the vessel.

The risers 2 are suspended from a rotating body in the form of a so-called turret 8 which is mounted in the vessel 1 by means of suitable bearing means 9, 10, 11. The turret 8 is anchored to the seabed by means of anchor chains (not shown), so that it is stationary relative to the seabed whereas the vessel can turn freely about the turret under the influence of wind and weather.

Between the risers 2 and the swivel unit 3 there is arranged a block 12 which is provided with channels or ducts 13 connecting the risers to respective swivel rings 5 through appurtenant axial courses 14 in the swivel core 4. Valve means in the form of closing or shut-off valves 15 are arranged at the top of the risers 2, and similar shut-off valves 16 are arranged between the outlets 6 of the swivel rings and the pipes 7.

The block 12 is fastened to a supporting pedestal 17 which in turn is fastened to the turret 8. Further, the swivel rings are fastened to the vessel 1 by means of moment arms 18.

FIG. 2 shows an example of ducts 13 in the block 12, as viewed from above. In practice the number of risers normally is from two to more than 40 (with an appurtenant increase in dimensions of the block 12 and in complexity with an increasing number of risers). FIG. 2 shows a block with four risers. The swivel unit 3 will then normally have four swivel rings.

With normal production, oil and/or gas flows up from the topical well through the risers 2, through the shut-off valves 15, the ducts 13 and the courses 14, and via the swivel rings 5 into the pipes 7 in the pipe system. When the vessel turns about the turret 8, the swivel rings are kept stationary relative to the vessel by means of the moment arms 18, and the swivel core 4 rotates within the rings 5. Between the swivel rings and the core there are arranged seals 19 seeing that liquid and gas do not leak out during the rotation. Normally, one riser is connected to one ring, so that each riser has a swivel ring of its own, even if it occurs that several risers are connected to one ring, or that one riser is connected to several rings.

As mentioned in the introduction, faults may arise in the sealing system on one of the swivel rings. In order to stop a leakage of oil or gas, the fluid flow through the ring in question has to be stopped in that the appurtenant valves into and out of the swivel are shut off. In the conventional installation shown in FIG. 1, this means that the production through the riser which is connected to this swivel ring, is stopped, something which may involve a substantial economic loss.

The above-mentioned drawback is avoided with the apparatus according to the invention, of which a first embodiment is shown in FIG. 3.

As appears from FIG. 3, the block 25 here is provided with a number of bores 26, 27 extending from the outside of the block and into respective ducts 28. In the illustrated embodiment, two bores 26 are arranged in line with appurtenant axial courses 14 in the swivel core 4, whereas two additional bores 27 are arranged between respective ones of the bores 26 and a vertical part of the duct 28 from the appurtenant riser 2.

In each of the bores 26 there is placed a sealing plug 29 which can be moved between the shown position and a position in which the duct 28 in question is closed. For movement of the plugs, in the illustrated embodiment there is provided a threaded rod 30 which is in threaded engagement with a lid or cover 31 covering and sealing the bore 26 in question. The two additional bores 27 are in turn covered by a sealing lid 32. The lids 31 and 32 suitably may be fastened in a sealing manner to the block 25 by means of screw bolts (not shown).

The two additional bores 27 may be interconnected by means of a branch pipe 33, as shown in FIG. 4, after preceding removal of the lids 32.

When using the illustrated apparatus, the sealing plugs 29 are operated for example as shown in FIG. 4, where it is presupposed that the seals 19 in the lowermost swivel ring 5 have started leaking. In this case all the valves 15 and 16 are closed, and the sealing plug 29 to the left in the Figure is pushed up to its closing position by means of the appurtenant threaded rod 30. Both swivel rings 5 are now shut off. The lids 32 are loosened from the block, and the branch pipe 33 is mounted, so that the bores 27 and therewith the risers 2 are connected to each other. The duct via the branch pipe 33 is pressure-tested, and the valve 15 lowermost to the right in the Figure and the upper valves 16 are opened. The production now can take place from both risers 2 into a common swivel ring 5, as illustrated by arrows in FIG. 4.

In practice there will be arranged branch pipes with different lengths, so that different branch pipes fit between different connecting points on the block 25. With reference to FIG. 2, the branch pipes for example may be adapted so that one branch pipe fits between the risers 2 and 2', whereas a somewhat longer branch pipe fits between the risers 2 and 2".

The connection points for the branch pipes in the illustrated embodiment are arranged at the underside of the block 25. However, they may also be arranged at the top or at the side of the block, dependent on where it is most practical to place such connection points in each individual case.

FIG. 5 shows an alternative embodiment of the cross connection arrangement according to the invention. In this embodiment there are not used separate branch pipes as in the embodiment according to FIGS. 3 and 4. Instead the apparatus comprises a block 37 which is provided with a number of interior interconnection ducts 38 forming a connection between two or more bores 39 which are shown to be arranged in a manner corresponding to the bores 26 in the block 25 in FIG. 3. In the bores 39 there are placed closing plugs 40 corresponding to the closing plugs 29 in FIG. 3, and which are operated by means of threaded rods 41. In the position shown in FIG. 5, the plugs 40 shut off the respective interconnection ducts. By means of the illustrated arrangement, the closing plugs 40 may be operated to form a connection between selected risers 2 and selected swivel rings 5 via respective interconnection ducts 38, as described later in connection with FIG. 7.

FIGS. 6A and 6B show the block 37 in two different configurations of interconnection ducts. Both Figures show a block having four appurtenant risers 2, in a similar manner as in the embodiment according to FIG. 2. In the alternative according to FIG. 6A, the channels 38' are interconnected at a central junction 42, so that any riser 2 can be connected to any swivel ring 5 via the appurtenant axial course 14 in the swivel core. In the alternative according to FIG. 6B, the two interconnection ducts 38" form a connection between selective bores 39, in order to form a connection between predetermined risers and swivel rings. Thus, the apparatus is prepared for specific reconnections.

Also in this embodiment a reconnection is carried out after one has registered a leakage in the seals of a swivel ring. In this connection reference is made to FIG. 7 wherein it is presupposed that the lower swivel ring 5 has started leaking. The valves 15 and 16 for the relevant risers and swivel rings are shut, and the sealing plug 40 which is to shutoff the swivel ring which is leaking, i.e. the left plug in FIG. 7, is pushed up to its upper closing position by means of the threaded rod 41. The sealing plug 40 which is to form a new connection to an alternative swivel ring, i.e. the right sealing plug in FIG. 7, is pulled down to the illustrated lower position in which the relevant interconnection duct 38 is opened. The shut-off valves 15 and 16 are opened again, and the production then may continue from all the risers.

As appears from FIG. 7, the seals 43 and 44 are arranged in connection with the sealing plugs 40 in the lower and upper positions thereof, to avoid leakage past the plugs.

The reconnection arrangement in the apparatus according to the invention may of course also be used if the relevant fluid runs in the opposite direction.

A further embodiment of an apparatus according to the invention is shown in a side view in FIG. 8.

This embodiment is constructed for use in cases where the rotating body to which the relevant risers are connected, consists of an underwater buoy which is arranged for releasable fastening in a receiving space in the vessel in question. In the Figure, an upper portion of such a buoy is suggested at 50.

As shown in the Figure, the apparatus comprises a block 51 which is arranged between the buoy 50 and a swivel unit 3 mounted on the block. The swivel unit may be constituted by a swivel stack of standard design. The block 51 here consists of an upper block unit 52 on which the swivel stack 3 is mounted, and a lower block unit 53 which is permanently secured to the buoy 50. The block units 52, 53 are adapted to be interconnected to each other by means of a suitable interconnection means, for example a hydraulic structure coupler. In the illustrated example each of the block units is provided with an encircling flange ring 54 and 55, respectively, and the flange rings are releasably interconnected by means of a number of hydraulic connecters 56 which can be operated for example by means of a remotely operated control means.

The block 51 is divided into an upper block unit 52 and a lower block unit 53 in order to reduce spill of hydrocarbons to a minimum when the block units are separated from each other when disconnecting the buoy.

In each of the block units there is built in a number of valves for selective closing of the interior ducts arranged in the block units and connecting the risers (not shown in FIG. 8) with appurtenant fluid courses in the swivel unit 3. In FIG. 8 there is only shown one valve 57 of the number of valves which are integrated in the upper block unit 52. The valve 57 is connected in a fluid course 58 (only shown dash-dotted), and this course in the illustrated embodiment is split into several courses 59 with appurtenant valves 57 in the lower block unit 53. Such an embodiment is particularly attractive for a gas lift swivel, as several gas risers then can be connected together to a common course through the swivel. This will imply a reduction of the number of seals and components in the upper block unit.

As further appears from FIG. 8, the upper block unit 52 is provided with a number of emergency shut-down valves (ESD valves) 60 for shut-off of the fluid courses in the block unit in case of a possible failure in the fluid transfer through the apparatus. In a corresponding manner the lower block unit 53 is provided with a number of manual isolation valves 61 for shut-off of the fluid courses in the block unit according to requirement.

An example of integration or building-in of shut-off valves in the block units 52 and 53 is shown in FIG. 9. As appears, a valve 62 in the form of a ball valve is connected in a duct 63 through the upper block unit 52. The valve is shown to comprise a rotatable valve ball 64 and a valve seat 65. The valve is coupled to an ESD valve 60 having an actuator 66 comprising e.g. a built-in spring package for closing and a hydraulic cylinder for opening. In a similar manner a valve 67 in the form of a ball valve is connected in a duct 68 through the lower block unit 53. The valve is coupled to a manual isolation valve 61 which is operated by a wheel 69 via a gearbox 70.

The ducts 63 and 68 are interconnected in a sealing manner by means of a sleeve-shaped sealing element 71 which is loosely preassembled in the upper block unit 52. Further, there is shown a sealing sleeve 72 for forming a tight connection between the duct 63 and the adjacent course in the swivel unit 3.

A flange connection 73 for a riser is suggested at the upper end of the relevant buoy 50.

What is claimed is:

1. An apparatus for transferring hydrocarbons from a subsea source to a vessel, wherein a number of risers are suspended from a rotating body and communicate with a swivel unit comprising a number of swivel rings having outlets which are coupled to a pipe system on the vessel, the apparatus comprising a block arranged between the risers and the swivel unit and provided with interior ducts for connection of the risers with respective swivel rings, means for selective closing of the ducts being arranged between the risers and the swivel unit, wherein the means for selective closing are integrated in the block, and wherein the block is also provided with means for selective interconnection of two or more of the ducts in the block.

2. An apparatus according to claim 1, wherein the rotating body comprises a buoy which may be connected to the vessel, and wherein the block comprises two block units of which an upper block unit is permanently secured to the swivel unit and a lower block unit is permanently secured to the buoy, the two block units being adapted for releasable interconnection with each other.

3. An apparatus according to claim 2, wherein the block units are interconnected by means of a hydraulically operated structure coupler.

4. An apparatus according to claim 1, wherein the block is provided with a number of bores extending from the outside of the block and into respective ducts, the means for selective closing comprising closing plugs of which each can be moved to a position in which the duct in question is shut off.

5. An apparatus according to claim 4, wherein the closing plugs are movable by means of respective threaded rods, each threaded rod being in threaded engagement with a cover over the bore in question.

6. An apparatus according to claim 4, wherein the block is provided with a number of additional bores extending from the outside of the block and into respective ducts, and which are normally shutoff by appurtenant lids, a number of branch pipes being arranged for providing a connection between selected ones of the additional bores after removal of the lids thereof.

7. An apparatus according to claim 6, wherein the branch pipes have different lengths, for allowing interconnection of bores having a different mutual distance.

8. An apparatus according to claim 4, wherein the block is provided with a number of interior interconnection ducts forming a connection between at least some of the bores, and which are arranged to be shut off by the closing plugs, the closing plugs being operable to form a connection between selected risers and selected swivel rings through respective interconnection ducts.

9. An apparatus according to claim 8, wherein the interconnection ducts at one end thereof are interconnected in a common junction, so that any riser can be connected to any swivel ring.

10. An apparatus according to claim 8, wherein the interconnection ducts are arranged to form a connection between selected bores, to form a connection between specific risers and swivel rings.

11. An apparatus according to claim 4, wherein the block is provided with sealing means for sealing between the block and the sealing plugs.

* * * * *